US009502163B2

(12) United States Patent
Chen et al.

(10) Patent No.: US 9,502,163 B2
(45) Date of Patent: Nov. 22, 2016

(54) PTC CIRCUIT PROTECTION DEVICE

(71) Applicant: FUZETEC TECHNOLOGY CO., LTD., New Taipei (TW)

(72) Inventors: Jack Jih-Sang Chen, New Taipei (TW); Chang-Hung Jiang, New Taipei (TW)

(73) Assignee: FUZETEC TECHNOLOGY CO., LTD., New Taipei (TW)

( * ) Notice: Subject to any disclaimer, the term of this patent is extended or adjusted under 35 U.S.C. 154(b) by 43 days.

(21) Appl. No.: 14/688,860

(22) Filed: Apr. 16, 2015

(65) Prior Publication Data

US 2016/0307672 A1 Oct. 20, 2016

(51) Int. Cl.

| | |
|---|---|
| ***H01C 7/10*** | (2006.01) |
| ***H01C 7/02*** | (2006.01) |
| ***H01C 7/00*** | (2006.01) |
| ***H01C 1/14*** | (2006.01) |

(52) U.S. Cl.

CPC ..... *H01C 7/028* (2013.01); *H01C 1/14* (2013.01); *H01C 7/008* (2013.01)

(58) Field of Classification Search

CPC ..... H01C 7/02; H01C 7/028; H01C 7/008; H01C 1/14; H01C 1/1406

USPC ..... 338/22 R, 13

See application file for complete search history.

(56) References Cited

U.S. PATENT DOCUMENTS

| | | | | |
|---|---|---|---|---|
| 3,900,552 | A * | 8/1975 | Hunter | C01B 31/30 423/492 |
| 4,910,389 | A * | 3/1990 | Sherman | H01C 7/027 219/504 |
| 7,286,038 | B1 * | 10/2007 | Wang | H01C 1/084 252/512 |
| 7,352,272 | B2 * | 4/2008 | Wang | H01B 1/22 252/511 |
| 7,382,224 | B2 * | 6/2008 | Wang | H01C 7/027 219/548 |
| 8,508,327 | B2 | 8/2013 | Chen et al. | |
| 8,508,328 | B1 * | 8/2013 | Chen | H01C 7/02 338/13 |
| 8,558,655 | B1 * | 10/2013 | Chen | H01C 7/027 338/13 |

* cited by examiner

*Primary Examiner* — Kyung Lee
(74) *Attorney, Agent, or Firm* — Foley & Lardner LLP

(57) ABSTRACT

The PTC circuit protection device includes a PTC polymer material and two electrodes attached to the PTC material. The PTC polymer material includes a polymer matrix and a conductive filler dispersed in the polymer matrix. The conductive filler includes first titanium carbide particles and second titanium carbide particles. The first titanium carbide particles have an average Fisher sub-sieve particle size of less than 2.5 μm. The second titanium carbide particles have an average Fisher sub-sieve particle size of less than 3.2 μm.

7 Claims, 1 Drawing Sheet

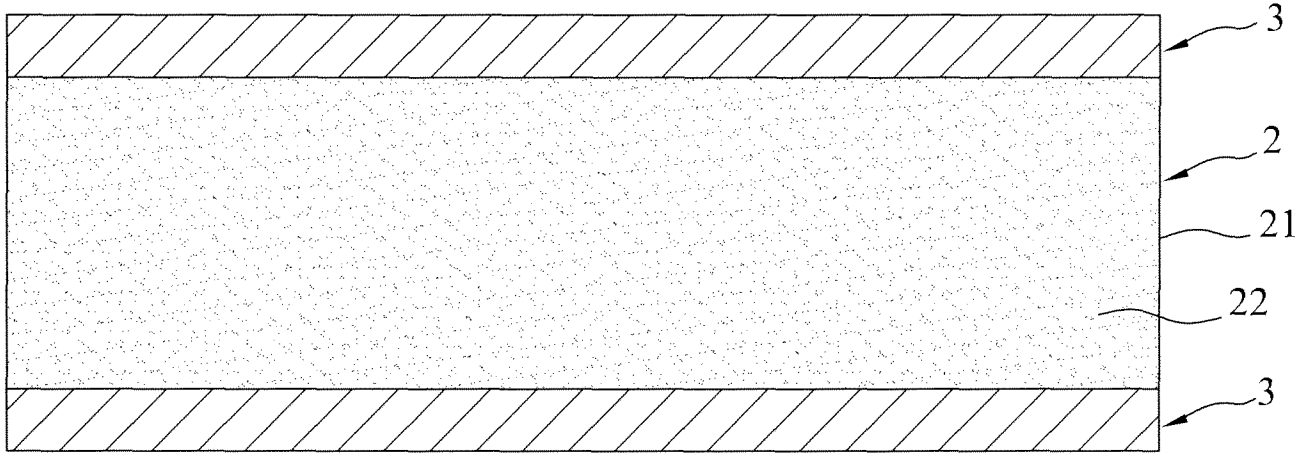
3
2
21
22
3

PTC CIRCUIT PROTECTION DEVICE

FIELD

This disclosure relates to a positive temperature coefficient (PTC) circuit protection device, more particularly to a positive temperature coefficient (PTC) circuit protection device including first and second titanium carbide particles having different particle size distributions.

BACKGROUND

A positive temperature coefficient (PTC) element exhibits a PTC effect that renders the same to be useful as a circuit protection device, such as a resettable fuse. The PTC element includes a PTC polymer material and first and second electrodes attached to two opposite surfaces of PTC polymer material.

The PTC polymer material includes a polymer matrix that contains a crystalline region and a non-crystalline region, and a particulate conductive filler dispersed in the non-crystalline region of the polymer matrix and formed into a continuous conductive path for electrical conduction between the first and second electrodes. The PTC effect is referred to as a phenomenon that when the temperature of the polymer matrix is raised to its melting point, crystals in the crystalline region start to melt, which results in generation of a new non-crystalline region. As the new non-crystalline region is increased to an extent to merge into the original non-crystalline region, the conductive path of the particulate conductive filler will become discontinuous and the resistance of the PTC polymer material will sharply increase, thereby resulting in electrical disconnection between the first and second electrodes.

Although the conductivity of the PTC polymer material can be considerably increased by using the particulate non-carbonaceous particles, such as metal powders, such conductive non-carbonaceous particles having high conductivity tend to result in undesired electric arc generated within the PTC polymer material during use.

The electric arc thus formed could deteriorate the molecular structure of the polymer matrix of the PTC polymer material and result in unstable electrical property of the PTC element and reduction in service life of the PTC element.

U.S. Pat. No. 8,508,327B2 discloses a PTC polymer material. The PTC polymer material includes a polymer matrix and titanium carbide particles dispersed in the polymer matrix. The titanium carbide particles have a residual oxygen content greater than 0.3 wt % based on a total weight of the titanium carbide particles, so that electrical stability of the PTC polymer material may be improved. However, there is still a need to improve the electrical stability of the PTC polymer material.

SUMMARY

Therefore, an object of the present disclosure is to provide a PTC circuit protection device that can further improve the electrical stability of PTC polymer material.

According to the present disclosure, there is provided a PTC circuit protection device that includes a PTC polymer material and two electrodes attached to the PTC polymer material.

The PTC polymer material includes a polymer matrix and a conductive filler dispersed in the polymer matrix. The conductive filler includes first titanium carbide particles and second titanium carbide particles.

The polymer matrix is made from a polymer composition that contains a base polyolefin and optionally a grafted polyolefin.

The first titanium carbide particles have an average Fisher sub-sieve particle size of less than 2.5 μm and a first particle size distribution that defines a particle size of D10 less than 1.6 μm, a particle size D50 of less than 4.5 μm, and a particle size D90 of less than 22.0 μm.

The second titanium carbide particles have an average Fisher sub-sieve particle size of less than 3.2 μm and a second particle size distribution that defines a particle size D10 of less than 2.5 μm, a particle size D50 of less than 6.5 μm, and a particle size D90 of less than 34.0 μm.

The first titanium carbide particles have a residual oxygen content greater than 0.3 wt % based on a total weight of the first conductive filler particles.

BRIEF DESCRIPTION OF THE DRAWING

In drawing which illustrates an embodiment of the disclosure.

FIG. 1 is a schematic view of the embodiment of a PTC circuit protection device according to this disclosure.

DETAILED DESCRIPTION OF THE EMBODIMENT

FIG. 1 illustrates the embodiment of a PTC circuit protection device that comprises a PTC polymer material 2 and two electrodes 3 attached to the PTC polymer material.

The PTC polymer material 2 includes a polymer matrix 21 and a conductive filler 22 which is dispersed in the polymer matrix 21. The conductive filler 22 includes first titanium carbide particles and second titanium carbide particles.

The polymer matrix 21 may be made from a polymer composition that contains a base polyolefin and optionally a grafted polyolefin.

It should be noted that, in certain embodiments of the present disclosure, the base polyolefin may be non-grafted polyethylene.

In an embodiment, the base polyolefin is high density polyethylene, and the grafted polyolefin is carboxylic acid anhydride grafted high density polyethylene, e.g., maleic anhydride grafted high density polyethylene.

The polymer matrix 21 is in an amount ranging from 8 wt % to 20 wt % and the conductive filler 22 is in an amount ranging from 80 wt % to 92 wt % based on a total weight of the PTC polymer material 2.

The weight ratio of the first titanium carbide particles to the second titanium carbide particles ranges from 1:9 to 9:1.

The first titanium carbide particles have an average Fisher sub-sieve particle size of less than 2.5 μm and a first particle size distribution that defines a particle size D10 of less than 1.6 μm, a particle size D50 of less than 4.5 μm, and a particle size D90 of less than 22.0 μm.

In certain examples of this embodiment, the average Fisher sub-sieve particle size of the first titanium carbide particle may be less than 1.4 μm. In certain examples of this embodiment, the particle size D90 of the first particle size distribution may be less than 12.0 μm.

The second titanium carbide particles may have an average Fisher sub-sieve particle size of less than 3.2 μm and a second particle size distribution that defines a particle size D10 of less than 2.5 μm, a particle size D50 of less than 6.5 μm, and a particle size D90 of less than 34.0 μm.

The first titanium carbide particles may have a residual oxygen content greater than 0.3 wt % based on a total weight of the first titanium carbide particles. The second titanium carbide particles may have a residual oxygen content less than that of the first titanium carbide particles.

In certain embodiments of this disclosure, the second titanium carbide particles may have a residual oxygen content less than 0.3 wt % based on a total weight of the second titanium carbide particles.

The following examples and comparative examples are provided to illustrate the embodiment of the invention, and should not be construed as limiting the scope of the invention.

EXAMPLE

Example 1 (E1)

10.5 g of high density polyethylene (HDPE) serving as a base polyolefin, 10.5 g of maleic anhydride grafted HDPE serving as a grafted polyolefin, 64.5 g of a first type of first titanium carbide particles (hereinafter referred to as A1 particles), and 64.5 g of a first type of second titanium carbide particles (hereinafter referred to as B1 particles) were compounded in a Brabender® blender. A1 particles have a Fisher sub-sieve particle size of 1.35 μm and a residual oxygen content (0%) of 0.9% (as shown in Table 1). A1 particles further have a particle size distribution defining a particle size D10 of 1.405 μm, a particle size D50 of 3.8 μm, and a particle size D90 of 11.79 μm (as shown in Table 1). A1 particles were made by subjecting $TiO_2$ and carbon particles to carbonization reaction at a temperature of around 1850° C. B1 particles have a Fisher sub-sieve particle size of 2.65 μm and a residual oxygen content of 0.2% (as shown in Table 1). B1 particles further have a particle size distribution defining a particle size D10 of 1.663 μm, a particle size D50 of 4.585 μm, and a particle size D90 of 22.371 μm (as shown in Table 1). B1 particles were made by subjecting $TiO_2$ and carbon particles to carbonization reaction at a temperature of around 2200° C. The compounding temperature was 200° C., the stirring rate was 50 rpm, the applied pressure was 5 Kg, and the compounding time was 10 minutes. The compounded mixture was hot pressed so as to form a thin sheet of the PTC polymer material having a thickness of 0.28 mm. The hot pressing temperature was 200° C., the hot pressing time was 4 minutes, and the hot pressing pressure was 80 $Kg/cm^2$. Two copper foil sheets were attached to two sides of the thin sheet and were hot pressed under 200° C. and 80 $Kg/cm^2$ for 4 minutes to form a sandwiched structure of a PTC laminate. The PTC laminate was cut into a plurality of test samples with a size of 4.5 mm×3.2 mm. The electrical property of the test samples of Example 1 was determined, and the results are shown in Table 3.

In Table 3, R represents resistance (ohm), and V-R represents the volume resistivity (ohm-cm). The PTC polymer material formed in Example 1 has a composition containing 14 wt % of the polymer matrix (the weight ratio of the base polyolefin to the grafted polyolefin is 1:1), 43 wt % of the first titanium carbide particles, and 43 wt % of the second titanium carbide particles.

Example 2 to 6 (E2 to E6)

The procedure and conditions in preparing the test samples of Examples 2 to 6 (E2 to E6) were similar to those of Example 1, except for the amounts of the base polyolefin, the grafted polyolefin, the first titanium carbide particles and the second titanium carbide particles. The electrical properties of the test samples of Examples 2 to 6 were determined, and the results are shown in Table 3.

Example 7 and 8 (E7 and E8)

The procedure and conditions in preparing the test samples of Examples 7 and 8 (E7 and E8) were similar to those of Example 1. The difference between Examples 7 and 8 and Example 1 resides in that 64.5 g of a second type of the second titanium carbide particles (hereinafter referred to as B2 particles) were employed in Examples 7 and 8. B2 particles have a Fisher sub-sieve particle size of 3.1 μm and a residual oxygen content of 0.2% (as shown in Table 1). B2 particles further have a particle size distribution defining a particle size D10 of 2.279 μm, a particle size D50 of 6.277 μm, and a particle size D90 of 33.761 μm (as shown in Table 1). B2 particles were made by subjecting $TiO_2$ and carbon particles to carbonization reaction at a temperature of around 2200° C. The amounts of the base polyolefin, the grafted polyolefin, the first titanium carbide particles and the second titanium carbide particles are shown in Table 2. The electrical properties of the test samples of Examples 7 and 8 were determined, and the results are shown in Table 3.

Comparative Example 1 (CE1)

The procedure and conditions in preparing the test samples of Comparative Example 1 (CE1) were similar to those of Example 1, except that the first and second titanium carbide particles (i.e., the conductive filler) were replaced with Ni particles and that the amounts of the components of the PTC polymer material were different. The electrical properties of the test samples of Comparative Example 1 were determined, and the results are shown in Table 3.

Comparative Example 2 (CE2)

The procedure and conditions in preparing the test samples of Comparative Example 2 (CE2) were similar to those of Comparative Example 1 (CE1). The difference between Comparative Example 2 and Comparative Example 1 resides in that the conductive filler of Comparative Example 2 includes 45 wt % of Ni particles and 45 wt % of B1 particles. The electrical properties of the test samples of Comparative Example 2 were determined, and the results are shown in Table 3.

Comparative Example 3 to 6 (CE3 to CE6)

The procedure and conditions in preparing the test samples of Comparative Examples 3 to 6 (CE3 to CE6) were similar to those of Example 1, except that the conductive filler of each of Comparative Examples 3 to 6 includes solely A1 particles and that the amounts of the components of the PTC polymer material are different. The electrical properties of the test samples of Comparative Examples 3 to 6 were determined, and the results are shown in Table 3.

Comparative Example 7 to 10 (CE7 to CE10)

The procedure and conditions in preparing the test samples of Comparative Examples 7 to 10 (CE7 to CE10) were similar to those of Example 1, except that the conductive filler of each of Comparative Examples 7 to 10 includes solely B1 particles and that the amounts of the components of the PTC polymer material are different. The electrical properties of the test samples of Comparative Examples 7 to 10 were determined, and the results are shown in Table 3.

Comparative Examples 11 and 12 (CE11 and CE12)

The procedure and conditions in preparing the test samples of Comparative Examples 11 and 12 (CE11 and CE12) were similar to those of Comparative Examples 7 and 8, except that the conductive filler of each of Comparative Examples 11 and 12 further includes B2 particles and that the amounts of the components of the PTC polymer material are different. The electrical properties of the test samples of Comparative Examples 11 and 12 were determined, and the results are shown in Table 3.

Comparative Example 13 and 14 (CE13 and CE14)

The procedure and conditions in preparing the test samples of Comparative Examples 13 and 14 (CE13 and CE14) were similar to those of Examples 3 and 4. The difference between Comparative Examples 13 and 14 and Examples 3 and 4 resides in that the conductive filler of each of Comparative Examples 13 and 14 includes A1 particles and a second type of the first titanium carbide particles (hereinafter referred to as A2 particles). A2 particles had a Fisher sub-sieve particle size of 4.4 μm and a residual oxygen content of 0.8% (as shown in Table 1). A2 particles further have a particle size distribution defining a particle size D10 of 3.717 μm, a particle size D50 of 10.54 μm, and a particle size D90 of 39.26 μm (as shown in Table 1). A2 particles were made by subjecting $TiO_2$ and carbon particles to carbonization reaction at a temperature of around 1850° C. The electrical properties of the test samples of Comparative Examples 13 and 14 were determined, and the results are shown in Table 3.

Comparative Example 15 and 16 (CE15 and CE16)

The procedure and conditions in preparing the test samples of Comparative Examples 15 and 16 (CE15 and CE16) were similar to those of Comparative Examples 13 and 14. The difference between Comparative Examples 15 and 16 and Comparative Examples 13 and 14 resides in that the conductive filler of each of Comparative Examples 15 and 16 includes B1 particles and A2 particles. The electrical properties of the test samples of Comparative Examples 15 and 16 were determined, and the results are shown in Table 3.

Comparative Example 17 and 18 (CE17 and CE18)

The procedure and conditions in preparing the test samples of Comparative Examples 17 and 18 (CE17 and CE18) were similar to those of Comparative Examples 13 and 14. The difference between Comparative Examples 17 and 18 and Comparative Examples 13 and 14 resides in that the conductive filler of each of Comparative Examples 17 and 18 includes B2 particles and A2 particles. The electrical properties of the test samples of Comparative Examples 17 and 18 were determined, and the results are shown in Table 3.

TABLE 1

| | A1 | A2 | B1 | B2 |
|---|---|---|---|---|
| Fisher sub-sieve particle size (μm) | 1.35 | 4.4 | 2.65 | 3.1 |
| D10 (μm) | 1.405 | 3.717 | 1.663 | 2.279 |
| D50 (μm) | 3.8 | 10.54 | 4.585 | 6.277 |
| D90 (μm) | 11.79 | 39.26 | 22.371 | 33.761 |
| O (%) | 0.9 | 0.8 | 0.2 | 0.2 |

TABLE 2

| | Base polyolefin wt % | Grafted polyolefin wt % | First titanium carbide particle wt % | | Second titanium carbide particle wt % | |
|---|---|---|---|---|---|---|
| Example | | | | | | |
| E1 | 7 | 7 | TiC-A1 | 43 | TiC-B1 | 43 |
| E2 | 6 | 6 | TiC-A1 | 44 | TiC-B1 | 44 |
| E3 | 5 | 5 | TiC-A1 | 45 | TiC-B1 | 45 |
| E4 | 4.5 | 4.5 | TiC-A1 | 45.5 | TiC-B1 | 45.5 |
| E5 | 4.5 | 4.5 | TiC-A1 | 81.9 | TiC-B1 | 9.1 |
| E6 | 4.5 | 4.5 | TiC-A1 | 9.1 | TiC-B1 | 81.9 |
| E7 | 5 | 5 | TiC-A1 | 45 | TiC-B2 | 45 |
| E8 | 4.5 | 4.5 | TiC-A1 | 45.5 | TiC-B2 | 45.5 |
| Comparative Example | | | | | | |
| CE1 | 5 | 5 | Ni | 90 | — | — |
| CE2 | 5 | 5 | Ni | 45 | TiC-B1 | 45 |
| CE3 | 7 | 7 | TiC-A1 | 86 | — | — |
| CE4 | 6 | 6 | TiC-A1 | 88 | — | — |
| CE5 | 5 | 5 | TiC-A1 | 90 | — | — |
| CE6 | 4.5 | 4.5 | TiC-A1 | 91 | — | — |
| CE7 | 7 | 7 | TiC-B1 | 86 | — | — |
| CE8 | 6 | 6 | TiC-B1 | 88 | — | — |
| CE9 | 5 | 5 | TiC-B1 | 90 | — | — |
| CE10 | 4.5 | 4.5 | TiC-B1 | 91 | — | — |
| CE11 | 5 | 5 | TiC-B1 | 45 | TiC-B2 | 45 |
| CE12 | 4.5 | 4.5 | TiC-B1 | 45.5 | TiC-B2 | 45.5 |
| CE13 | 5 | 5 | TiC-A1 | 45 | TiC-A2 | 45 |
| CE14 | 4.5 | 4.5 | TiC-A1 | 45.5 | TiC-A2 | 45.5 |
| CE15 | 5 | 5 | TiC-B1 | 45 | TiC-A2 | 45 |
| CE16 | 4.5 | 4.5 | TiC-B1 | 45.5 | TiC-A2 | 45.5 |
| CE17 | 5 | 5 | TiC-B2 | 45 | TiC-A2 | 45 |
| CE18 | 4.5 | 4.5 | TiC-B2 | 45.5 | TiC-A2 | 45.5 |

<Performance>

[Resistance Stability Test]

A Ni sheet was soldered to the copper foil sheets of the test sample (having a resistance $R_c$) of each of E1 to E8 and CE1 to CE18 to form a test device. The resistance ($R_d$) of the test device was determined. A resistance increasing ratio ($R_{cd}$) is defined as $(R_d-R_c)/R_c \times 100\%$. The results of the resistance stability test are shown in Table 3.

TABLE 3

| | Rc (ohm) | Rd (ohm) | Rcd | Device V − R (ohm × cm) |
|---|---|---|---|---|
| Example | | | | |
| E1 | 0.00698 | 0.01892 | 171% | 0.0778 |
| E2 | 0.00239 | 0.00637 | 167% | 0.0262 |
| E3 | 0.00168 | 0.00472 | 181% | 0.0194 |
| E4 | 0.00111 | 0.00302 | 172% | 0.0124 |
| E5 | 0.00151 | 0.00407 | 170% | 0.0167 |
| E6 | 0.00145 | 0.00398 | 174% | 0.0164 |
| E7 | 0.00162 | 0.00456 | 181% | 0.0188 |

TABLE 3-continued

| | Rc (ohm) | Rd (ohm) | Rcd | Device V − R (ohm × cm) |
|---|---|---|---|---|
| E8 | 0.00109 | 0.00305 | 180% | 0.0125 |
| Comparative Example | | | | |
| CE1 | 0.00047 | 0.00275 | 485% | 0.0113 |
| CE2 | 0.00098 | 0.00513 | 423% | 0.0211 |
| CE3 | 0.01740 | 0.05320 | 206% | 0.2189 |
| CE4 | 0.00296 | 0.00914 | 209% | 0.0376 |
| CE5 | 0.00219 | 0.00684 | 212% | 0.0281 |
| CE6 | 0.00162 | 0.00531 | 228% | 0.0218 |
| CE7 | 0.00227 | 0.00813 | 258% | 0.0334 |
| CE8 | 0.00181 | 0.00653 | 261% | 0.0269 |
| CE9 | 0.00175 | 0.00702 | 301% | 0.0289 |
| CE10 | 0.00171 | 0.00698 | 308% | 0.0287 |
| CE11 | 0.00185 | 0.00733 | 296% | 0.0302 |
| CE12 | 0.00174 | 0.00706 | 306% | 0.0290 |
| CE13 | 0.00165 | 0.00501 | 204% | 0.0206 |
| CE14 | 0.00163 | 0.00503 | 209% | 0.0207 |
| CE15 | 0.00171 | 0.00541 | 216% | 0.0223 |
| CE16 | 0.00168 | 0.00524 | 212% | 0.0216 |
| CE17 | 0.00166 | 0.00551 | 232% | 0.0227 |
| CE18 | 0.00163 | 0.00548 | 236% | 0.0225 |

The results show that the resistance and the resistance increasing ratio of the test device of each of E1 to E8 are much lower than those of the CE1 to CE18.

[Endurance Test]

Ten test samples for each of E1 to E8 and CE1 to CE18 were subjected to an endurance test under an applied power of 6 Vdc/10 A with a power-on state for 60 seconds and a power-off state for 60 seconds for 7200 cycles so as to determine a resistance variance ($R_f/R_i$) and the pass ratio of the test samples, where $R_i$ and $R_f$ represent the resistances of the test sample before and after the endurance test, respectively. Table 4 shows that E1 to E8 have a pass ratio of 100%, while CE1, CE2 and CE8 to CE18 have a pass ratio of less than 100%. Besides, the resistance variance among E1 to E8 is much lower than that among CE3 to CE18.

TABLE 4

| Sample | Rd (ohm) | Rf/Ri × 100% | Pass ratio |
|---|---|---|---|
| Example | | | |
| El | 0.01892 | 1677% | 100% |
| E2 | 0.00637 | 1778% | 100% |
| E3 | 0.00472 | 1884% | 100% |
| E4 | 0.00302 | 1888% | 100% |
| E5 | 0.00407 | 1677% | 100% |
| E6 | 0.00398 | 1995% | 100% |
| E7 | 0.00456 | 1769% | 100% |
| E8 | 0.00305 | 1844% | 100% |
| Comparative Example | | | |
| CE1 | 0.00275 | NA | 0% |
| CE2 | 0.00513 | NA | 0% |
| CE3 | 0.05320 | 3675% | 100% |
| CE4 | 0.00914 | 4368% | 100% |
| CE5 | 0.00684 | 5403% | 100% |
| CE6 | 0.00531 | 5561% | 100% |
| CE7 | 0.00813 | 122032% | 100% |
| CE8 | 0.00653 | 178954% | 90% |
| CE9 | 0.00702 | 313223% | 80% |
| CE10 | 0.00698 | 430078% | 80% |
| CE11 | 0.00733 | 353223% | 70% |
| CE12 | 0.00706 | 530078% | 60% |
| CE13 | 0.00501 | 7403% | 50% |
| CE14 | 0.00503 | 8561% | 40% |
| CE15 | 0.00541 | 77403% | 40% |
| CE16 | 0.00524 | 88561% | 30% |
| CE17 | 0.00551 | 91403% | 30% |
| CE18 | 0.00548 | 128561% | 30% |

With the inclusion of the first titanium carbide particles and the second titanium carbide particles in the PTC polymer material of the PTC circuit protection device according to the present disclosure, the electrical stability of the PTC circuit protection device of this disclosure can be improved.

While the present disclosure has been described in connection with what is considered the most practical embodiment, it is understood that this disclosure is not limited to the disclosed embodiment but is intended to cover various arrangements included within the spirit and scope of the broadest interpretation and equivalent arrangements.

What is claimed is:

1. A PTC circuit protection device comprising:

a PTC polymer material; and two electrodes attached to said PTC polymer material;

wherein said PTC polymer material includes a polymer matrix and a conductive filler dispersed in said polymer matrix, said conductive filler including first titanium carbide particles and second titanium carbide particles;

wherein said polymer matrix is made from a polymer composition that contains a base polyolefin and optionally a grafted polyolefin;

wherein said first titanium carbide particles have an average Fisher sub-sieve particle size of less than 2.5 μm and a first particle size distribution that defines a particle size D10 of less than 1.6 μm, a particle size D50 of less than 4.5 μm, and a particle size D90 of less than 22.0 μm;

wherein said second titanium carbide particles have an average Fisher sub-sieve particle size of less than 3.2 μm and a second particle size distribution that defines a particle size D10 of less than 2.5 μm, a particle size D50 of less than 6.5 μm, and a particle size D90 of less than 34.0 μm; and wherein said first titanium carbide particles have a residual oxygen content greater than 0.3 wt % based on a total weight of said first titanium carbide particles.

2. The PTC circuit protection device according to claim 1, wherein said average Fisher sub-sieve particle size of said first titanium carbide particle is less than 1.4 μm.

3. The PTC circuit protection device according to claim 1, wherein said polymer matrix is in an amount ranging from 8 wt % to 20 wt % and said conductive filler is in an amount ranging from 80 wt % to 92 wt % based on a total weight of said PTC polymer material.

4. The PTC circuit protection device according to claim 1, wherein the weight ratio of said first titanium carbide particles to said second titanium carbide particles ranges from 1:9 to 9:1.

5. The PTC circuit protection device according to claim 1, wherein said particle size D90 of said first particle size distribution is less than 12.0 μm.

6. The PTC circuit protection device according to claim 1, wherein said second titanium carbide particles have a residual oxygen content less than 0.3 wt % based on a total weight of said second titanium carbide particles.

7. The PTC circuit protection device according to claim 1, wherein said base polyolefin is high density polyethylene, and said grafted polyolefin is carboxylic acid anhydride grafted high density polyethylene.

* * * * *